United States Patent [19]

Furukawa et al.

[11] Patent Number: 4,771,948

[45] Date of Patent: Sep. 20, 1988

[54] COMBINATION OF A FUEL INJECTION VALVE AND A NOZZLE

[75] Inventors: Hiroshi Furukawa; Hitoshi Takeuchi, both of Obu, Japan

[73] Assignee: Aisan Kogyo Kabushiki Kaisha, Obu, Japan

[21] Appl. No.: 74,154

[22] Filed: Jul. 16, 1987

[30] Foreign Application Priority Data

Aug. 19, 1986 [JP] Japan ..... 61-193522

[51] Int. Cl.[4] ..... F02M 61/00; F02M 51/00

[52] U.S. Cl. ..... 239/533.12; 239/562; 239/565; 239/585

[58] Field of Search ..... 239/533.3–533.12, 239/553, 524, 585, 512, 590, 562, 565; 251/129.15

[56] References Cited

U.S. PATENT DOCUMENTS

| | | | |
|---|---|---|---|
| 3,894,691 | 7/1975 | Mee | 239/572 X |
| 4,657,189 | 4/1987 | Iwata et al. | 239/585 |

FOREIGN PATENT DOCUMENTS

| | | | |
|---|---|---|---|
| 357247 | 3/1938 | Italy | 239/533.12 |
| 461546 | of 1951 | Italy | 239/533.9 |
| 152458 | 9/1982 | Japan . | |
| 90365 | 6/1983 | Japan . | |
| 113065 | 6/1985 | Japan . | |
| 97584 | 6/1986 | Japan . | |
| 97583 | 6/1986 | Japan . | |
| 97582 | 6/1986 | Japan . | |
| 88059 | 6/1986 | Japan . | |
| 120076 | 7/1986 | Japan . | |
| 105759 | 7/1986 | Japan . | |
| 201556 | 3/1924 | United Kingdom | 239/533.12 |

*Primary Examiner*—Andres Kashnikow

*Attorney, Agent, or Firm*—Dennison, Meserole, Pollack & Scheiner

[57] ABSTRACT

In a nozzle of an electromagnetic fuel injection valve, the nozzle comprises a columnar body extending forwardly from the front end of the valve body, a plurality of fuel atomizer holes formed in the columnar body on a circle about an axis of the columnar body in equally spaced relationship with each other, the fuel atomizer holes being outwardly inclined in accordance with the direction of fuel atomization, a conical portion formed at an axial portion of the columnar body in such a manner as to be surrounded by the fuel atomizer holes, and a fuel distributing portion formed at the top of the conical portion for atomizing the liquid fuel columnarly injected from the valve body, the fuel distributing portion having a predetermined sectional area in a direction perpendicular to the axis of the columnar body whereby the liquid fuel atomized in the nozzle is supplied to a predetermined circular area at a fixed distance.

1 Claim, 7 Drawing Sheets

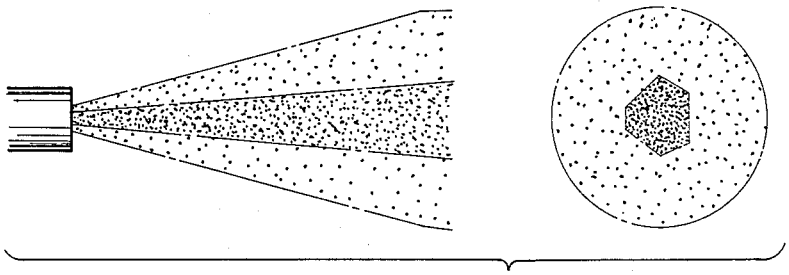
PINTLE TYPE FIG. 7B PRIOR ART
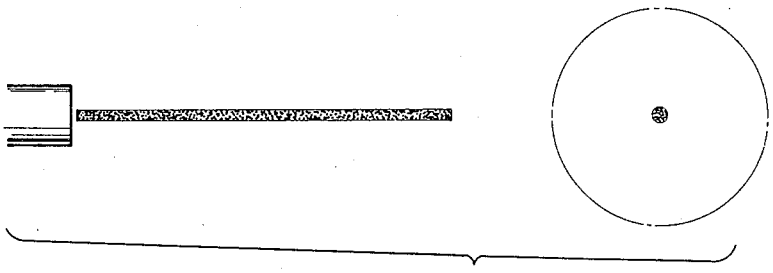
SINGLE-HOLE TYPE FIG. 7A PRIOR ART

COMBINATION OF A FUEL INJECTION VALVE AND A NOZZLE

BACKGROUND OF THE INVENTION

The present invention relates to a combination of a fuel injection valve having a single fuel injection hole and a nozzle, and more particularly to an improved structure of a nozzle which is designed to improve fuel atomization, especially for use with an engine having a single intake valve per cylinder.

Generally, an engine having a single intake valve per cylinder employs a pintle type injection valve having fuel atomization and emission characteristics better than a single hole type injection valve. However, the fuel deposit property of the pintle type injection valve is inferior to that of the single hole type injection valve because of the valve structure of the former, causing blocking of the fuel injection hole and accordingly reducing the flow of fuel. On the other hand, since the single hole type injection valve injects fuel columnarly and not in a conical shape, satisfactory atomization of the fuel cannot be obtained, and the formation characteristics of the air/fuel mixture is inferior to that of the pintle type injection valve. Especially when the atomization is not sufficient under cold engine condition, the amount of HC emission is increased, and as a result, the feedback control characteristic is deteriorated causing an increase in unburnt components other than HC.

There are described some countermeasures against the above problems in Japanese Utility Model Laid-Open Publication No. 57-152458, wherein an atomizing adapter is located downstream of a single hole type fuel injection valve, so as to prevent the blocking of the injection aperture caused by the fuel deposition and coincidently to provide a fuel atomization characteristic equal to or higher than a pintle type fuel injection valve. However, it is difficult in actual manufacturing to locate such an obstacle adapter downstream of a small fuel injection hole in coaxial relationship therewith.

In the case of mounting the prior art injection valve just above an intake valve in an intake manifold of an engine, the atomized fuel cannot be effectively supplied to the engine without the deposition of the fuel onto a wall surface of the intake manifold, or by the prior art injection valve, the fuel pressure at the fuel injection hole does not change equally to the intake manifold pressure. Therefore, accurate fuel metering cannot be achieved unless some characteristics required to the valve mentioned above are satisfied. Thus, the prior art has not yet solved the problems in fuel deposition property, fuel atomization characteristic, fuel metering characteristic and coincidently productivity.

SUMMARY OF THE INVENTION

It is an object of the present invention to provide a structure for a nozzle to be attached to a fuel injection valve which will improve fuel atomization, fuel metering, fuel deposit property and coincidently productivity.

It is another object of the present invention to provide a structure of a nozzle to be attached to a fuel injection valve which will satisfy engine operational characteristics from cold starting to high-load running condition without providing any additional fuel injection valve for engine cold starting.

According to the present invention, there is provided a structure for a nozzle to be attached to a fuel injection valve including a valve body which comprises a valve housing having a single fuel injection hole, and a valve member adapted to be reciprocated in the valve housing by an electromagnetic or mechanical force and the resilient force of a spring so as to intermittently inject fuel from the nozzle mounted at the front end of the valve body. The nozzle comprises a columnar body extending forwardly from the front end of the valve body. This columnar body includes at least three fuel atomizer holes formed in a circle about an axis of the columnar body in equally spaced relationship with each other, the fuel atomizer apertures being outwardly inclined in relation to the direction of columnar fuel flow from the fuel injection hole, a conical portion surrounded by the fuel atomizer holes, and a fuel atomizing portion formed at the upstream end of the conical portion for atomizing the liquid fuel columnarly injected from the valve body, the fuel atomizing portion having a predetermined sectional area in a direction perpendicular to the axis of the columnar body whereby the fuel atomized in the nozzle is discharged in a conical shape within a predetermined circular area at a fixed distance from the nozzle.

With this structure, when the valve member is moved rearwardly, fuel is columnarly injected through the injection hole of the valve housing, and is then impacted against the fuel atomizing portion formed at the upstream end of the conical portion of the nozzle, thereby atomizing the fuel. Since the fuel atomizing portion has a predetermined sectional area in the direction perpendicular to the axis of the columnar body of the nozzle, and the fuel atomizer holes are formed in equally spaced relationship with each other, the fuel columnarly injected through the injection hole is circularly uniformly atomized, and is uniformly distributed into the fuel atomizer apertures. The distributed fuel is effectively supplied to a predetermined circular area at a fixed distance from the nozzle under the condition where expansion of the atomized fuel is restricted by each end opening of the fuel atomizer holes. Furthermore, since the plurality of fuel atomizer holes are arranged along a circle about the axis of the nozzle in equally spaced relationship with each other, a sufficient area of the fuel atomizer holes can be obtained between the fuel injection hole and the end openings of the nozzle. Therefore, blocking of fuel flow is prevented and fuel pressure at the fuel injection hole of the valve body changes equally to pressure at the outer openings of the fuel atomizer holes, thereby securing sufficient fuel metering accuracy.

The invention will be more fully understood from the following detailed description and appended claims when taken with the drawings.

BRIEF DESCRIPTION OF THE DRAWINGS

FIGS. 7A and 7B are illustrations showing a fuel injection condition in the prior art;

DETAILED DESCRIPTION OF THE PREFERRED EMBODIMENTS

Figure 1:
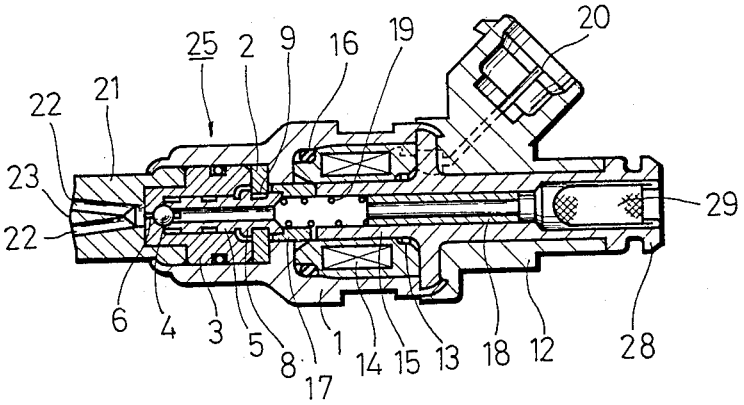
FIG. 1 is a sectional elevation of a preferred embodiment of the present invention.

Referring to FIGS. 1 to 6, reference numeral 1 designates an injector body having a valve housing 3 at its front portion (left portion as viewed in FIG. 1) and a stopper 2 interposed between the injector body 1 and the valve housing 3. A valve member 5 having a ball 4 at its front end is axially movably mounted in the valve housing 3 in such a manner that a stroke of the valve member 5 is restricted between a front end surface of the stopper 2 and a valve seat 7 formed around a fuel injection hole 6 at the front end of the valve housing 3. When the valve member 5 is moved toward the fuel injection hole 6, and the ball 4 of the valve member 5 abuts against the valve seat 7, the fuel injection hole 6 is closed to stop fuel injection from the fuel injection hole 6. On the other hand, when the valve member 5 is moved toward the stopper 2, and a flange 8 of the valve member 5 abuts against the front end surface of the stopper 2, the fuel injection hole 6 is opened to inject the fuel therefrom and the fuel is supplied through a groove 9 of the stopper 2 and fuel injection passages 10 and 11 of the valve member 5.

A solenoid coil 14 is mounted in the injector body 1 through a connector 12 and an O-ring 13 for preventing fuel leakage. A fixed iron core 15 formed of a ferromagnetic material is inserted into the solenoid coil 14 through an O-ring 16 for preventing fuel leakage. An armature 17 is provided at a rear end portion of the valve member 5, and is adapted to be attracted to the fixed iron core 15 by excitation of the solenoid coil 14. A spring 19 is provided between the armature 17 and a pipe 18 inserted into the fixed iron core 15 and fixed by a punch or the like after adjustment of position. The spring 19 applies a biasing force to the armature 17 and the valve member 5 in a counter direction of the attraction force of the solenoid coil 14, so as to abut the ball 4 of the valve member 5 against the valve seat 7 of the valve housing 3. The solenoid coil 14 is connected through a terminal 20 to an external circuit.

Figure 4:
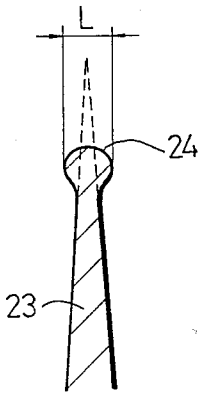
FIGS. 4 and 5 are enlarged views of essential parts in FIG. 3.

A nozzle 21 is mounted with the valve housing 3 at the front end of the injector body 1. The nozzle 21 includes a columnar body 21*a* extending forwardly from the front end of the injector body 1, three fuel atomizer holes 22 formed in the columnar body 21*a* in a circle about an axis of the columnar body 21*a* in equally spaced relationship with each other, the fuel atomizer holes 22 being outwardly inclined in relation to the direction of columnar fuel flow from the fuel injection hole, a conical portion 23 surrounded by the fuel atomizer apertures 22 at an axial portion of the columnar body, a fuel atomizing portion 24 formed at the upstream end of the conical portion 23 for atomizing the liquid fuel columnarly injected through the injection hole 6. The fuel atomizing portion 24 has a predetermined sectional area, that is, the width L as shown in FIG. 4 in a direction perpendicular to the axis of the columnar body 21*a*, whereby the fuel atomized in the nozzle 21 is supplied to a predetermined circular area at a fixed distance from the nozzle 21.

Figure 5:
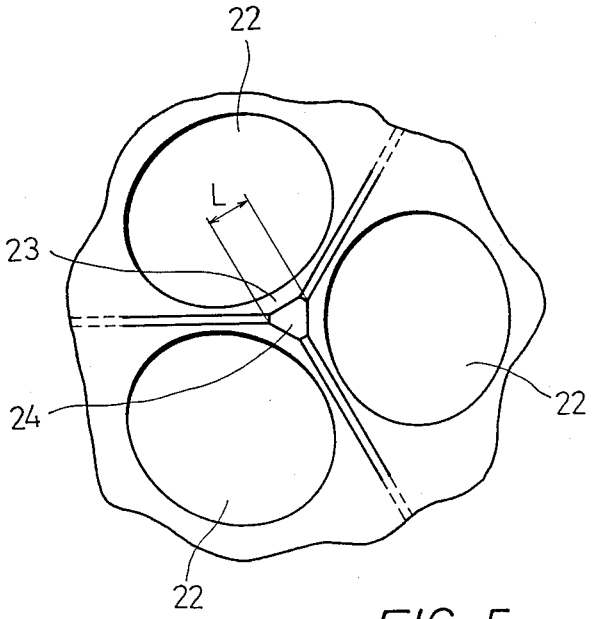
Figure 3:
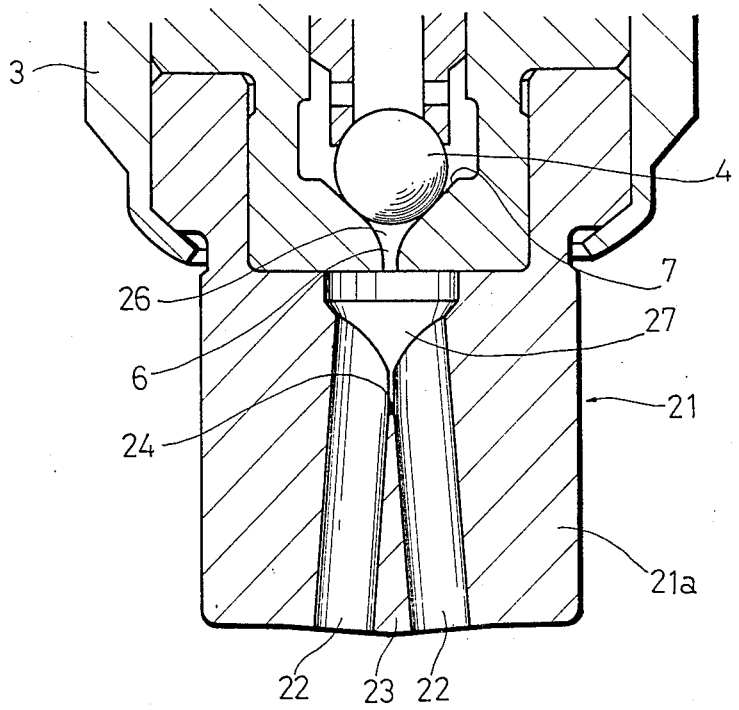
FIG. 3 is a sectional view taken along the line A—A in FIG. 2.
Figure 2:
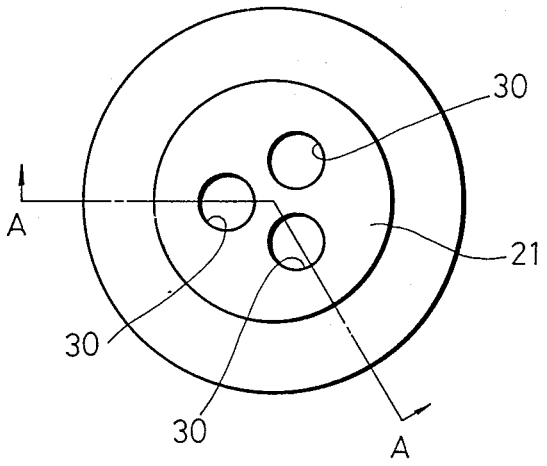
FIG. 2 is a left side view of FIG. 1.
Figure 6:
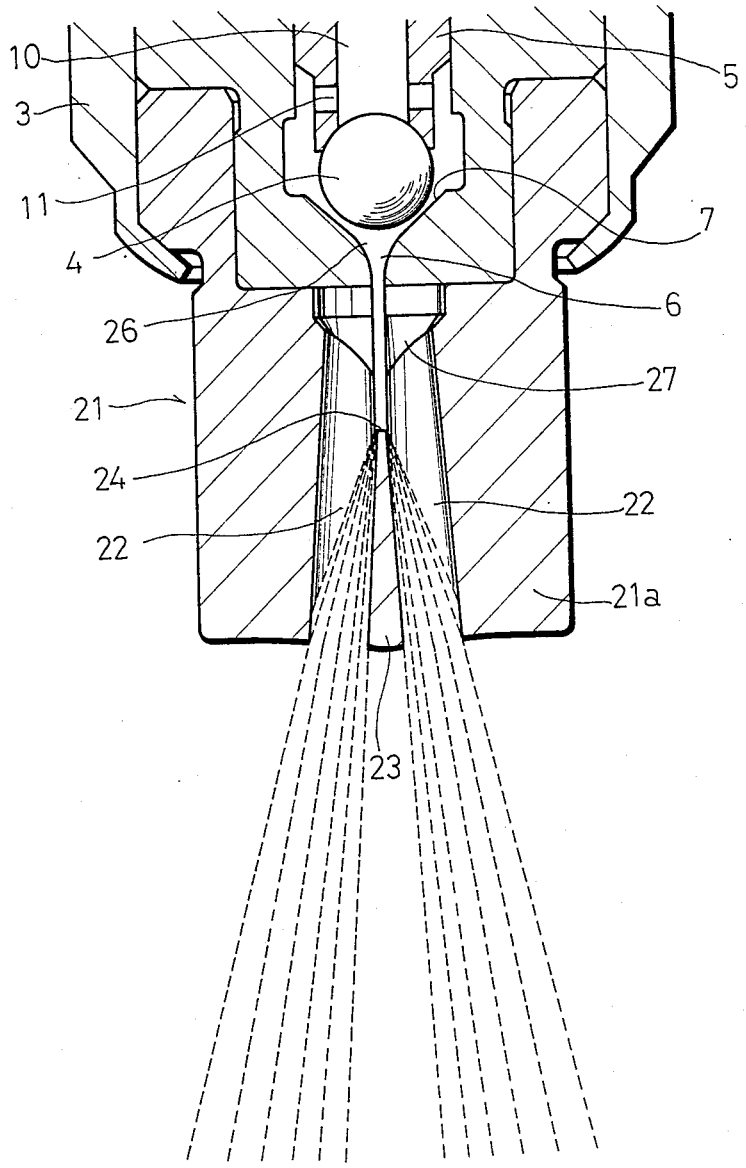
FIG. 6 is an enlarged view showing a fuel injection condition.

There will now be described a detailed structure of the nozzle 21 attached to an electromagnetic fuel injection valve 25. A fuel passage 26 is formed in the valve housing 3, and is adapted for communication with the fuel passages 10 and 11 of the valve member 5. The single injection hole 6 is formed at the extream downstream portion of the fuel passage 26 so as to meter the fuel supplied through the fuel passage 26. Each of the three fuel atomizer holes 22 formed in the nozzle 21 downstream of the fuel injection aperture 6 has a circular section and acts as a fuel passage for supplying the distributed flow of fuel. A junction portion 27 of the three fuel atomizer holes 22 is formed between the fuel injection aperture 6 and the fuel atomizer holes 22. The conical portion 23 for distributing the flow of atomized fuel is formed downstream of the junction portion 27 as a part of the columnar body 21*a* except the fuel atomizer holes 22. The fuel atomizing portion 24 formed at the upstream end of the conical portion 23 has a bulb-shaped surface as shown in FIG. 4. In the embodiment where the nozzle 21 has three atomizer holes 22, the fuel atomizing portion 24 has a shape of triangular pyramid with an enlarged round peak such as a spherical peak as shown in FIGS. 4 and 5. In the embodiment of four atomizer apertures, a rectangular pyramidal shape with an enlarged round peak such as a spherical peak is adapted, and so on. This subtantially round surface of the fuel atomizing portion 24 is formed, for example, by a so-called shot blast method where particles having a small size are sprayed to the top of the conical portion 23.

In operation, when the solenoid coil 14 of the electromagnetic fuel injection valve 25 is not excited, fuel fed from a fuel hose (not shown) connected to a plug 28 integrally formed with the fixed iron core 15 through a strainer 29 is not injected from the fuel injection hole 6 since the fuel injection hole 6 is closed by the biasing force of the spring 19.

Upon excitation of the solenoid coil 14, the armature 17 is attracted to the fixed iron core 15 against the biasing force of the spring 19 until the flange 8 of the valve member 5 abuts against the stopper 2. As a result, the fuel injection hole 6 is opened, and the fuel is injected through the fuel injection hole 6. The amount of fuel to be injected through the injection hole 6 can be metered by the function of the difference between the fuel pressure and the pressure at the outer openings of the nozzle and the difference between the area of fuel passage 26 and injection hole 6. The metered fuel is introduced into the junction portion 27 of the nozzle 21 in the form of a columnar (solid) spray, and is then impacted against the fuel atomizing portion 24 formed at the upsteam end of the conical portion 23 of the nozzle 21. Accordingly, the fuel is atomized and distributed into an equal amount to be injected from each fuel atomizer hole 22. End openings 30 of the fuel atomizer holes 22 act to restrict expansion of the atomized fuel to be injected through the fuel atomizer holes 22.

Fuel atomization is influenced by the width L of the fuel atomizing portion 24. If the width L is too small, the fuel cannot be sufficiently atomized. Preferably, the width L of the fuel atomizing portion 24 is at least about 0.1 mm in the case that the diameter of the fuel injection hole 6 is 0.4 mm, so that the fuel injected from the fuel injection hole 6 may start atomizing and improve the fuel atomization.

FIGS. 7A and 7B show a fuel injection condition of conventional electromagnetic fuel injection valves under atmospheric pressure. Referring to FIG. 7A which shows a fuel injection condition of the single-hole type injection valve, fuel is injected columnarly, and fuel atomization is not satisfactory. On the other hand, referring to FIG. 7B which shows a fuel injection condition of a pintle type injection valve, a fuel is injected in a conical shape having a vertical angle of about 30 degrees, and fuel atomization is superior to that of the single-hole type, except a problem of fuel deposit and injection aperture blocking occurs. Accordingly, it is considered that the pintle type injection valve is a better construction for an engine than a single hole type injection valve.

Figure 8D:
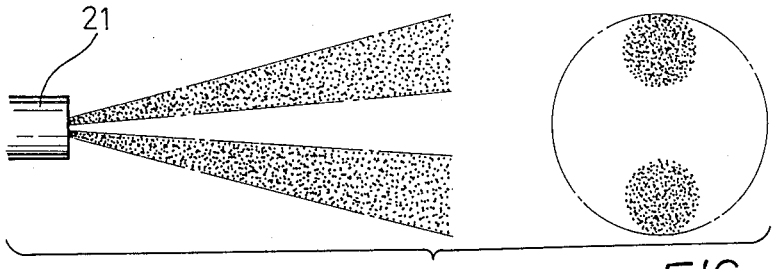
FIG. 8D PRIOR ART
FIG. 8D is an illustration showing a fuel injection condition in the prior art.
Figure 8C:
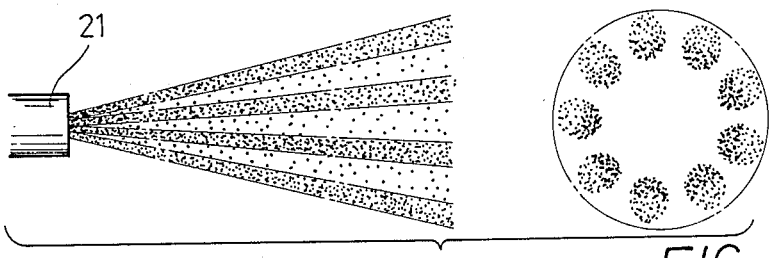
FIGS. 8A to 8C are illustrations showing a fuel injection condition according to the present invention.
Figure 8B:
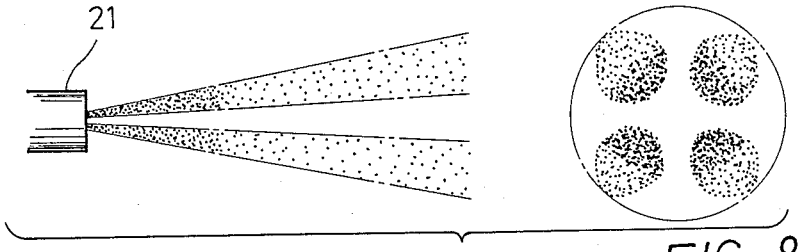
Figure 8A:
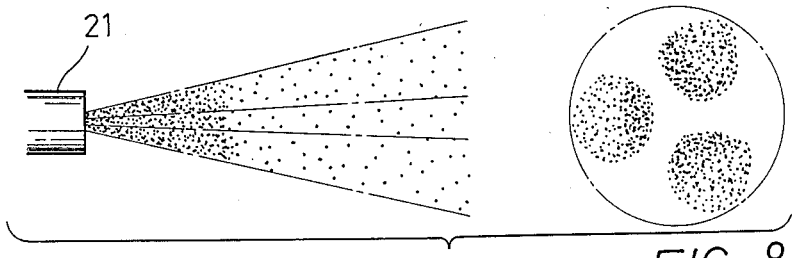

FIGS. 8A to 8C show a fuel injection condition of various electromagnetic fuel injection valves according to the present invention, and the width L of the fuel atomizing portion 24 is set to be about 0.2 mm. The injection valve shown in FIG. 8A is of a three-hole type having three fuel atomizer holes 22 in the nozzle 21, while the injection valve shown in FIG. 8B is of a four-hole type having four fuel atomizer holes 22. Both the injection valves of FIGS. 8A and 8B may provide a fuel atomized condition of a conical shape having a vertical angle of about 30 degrees. As compared with the pintle type injection valve, the blank area where fuel is not distributed is generated, but a main fuel atomizing portion formed at a central area of an atomized fuel flow in the pintle type injection valve shown in FIG. 7B as a densely dotted area is not generated. Therefore, fuel atomization of the injection valves of FIGS. 8A and 8B is equal to or more satisfactory than the pintle type injection valve, and uniformity of atomization may be improved as a whole.

The fuel injection valve as shown in FIG. 8C is of a nine-hole type having nine fuel atomizer holes 22 in the nozzle 21. In this case, the diameter of each fuel atomizer hole 22 is smaller than that of the three-hole or the four-hole type fuel injection valve, and accordingly the fuel atomized at the fuel atomizing portion 24 tends to contract in the fuel atomizer holes 22, causing insufficient atomization of the fuel. On the other hand, the fuel injection valve as shown in FIG. 8D is of a conventional two-hole type having two fuel atomizer holes 22 in the nozzle 21. In this case, the blank area of the fuel is large, and the fuel distributed part becomes small, causing unsatisfactory atomization of the fuel. As a result, a uniform air/fuel mixture cannot be obtained.

Figure 9:
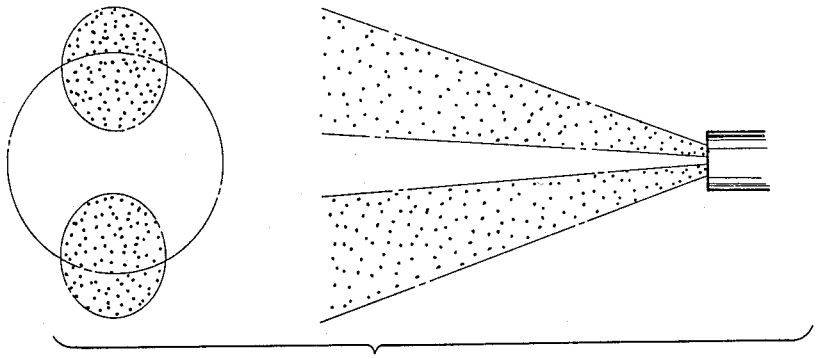
FIG. 9 PRIOR ART
FIGS. 9 and 10 are illustrations showing a fuel injection condition of a two-hole type fuel injection valve in the prior art.
Figure 10:
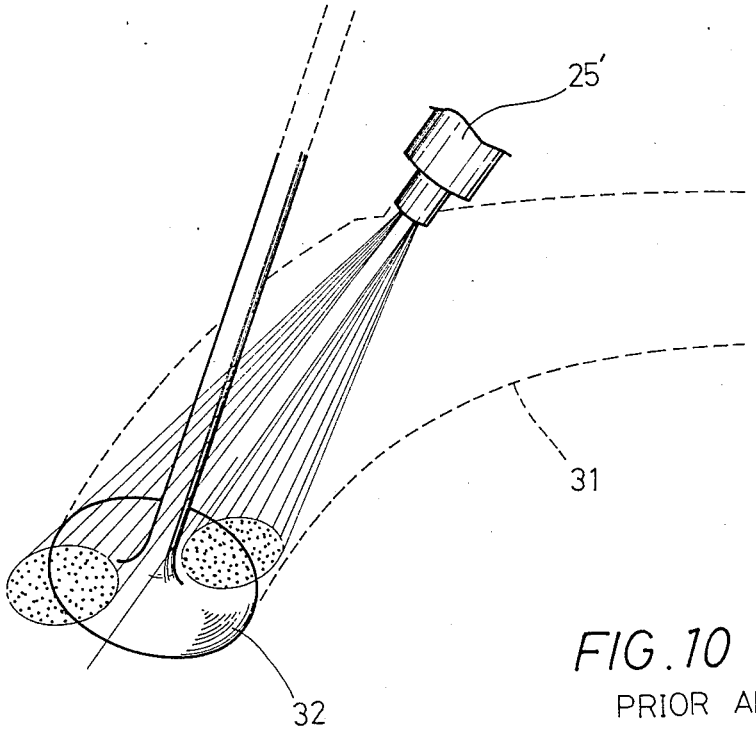
FIG. 10 PRIOR ART
Figure 11:
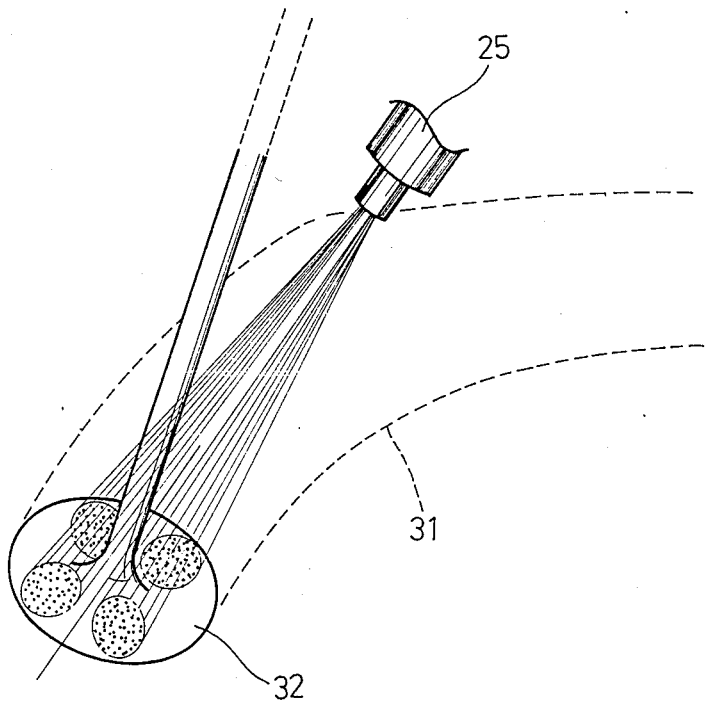
FIG. 11 is an illustration showing a fuel injection condition of a four-hole type fuel injection valve.

FIGS. 9 and 10 show a fuel injection condition of a two-hole type injection valve 25' having a shorter length of the fuel atomizer apertures 22 as compared with the injection valve shown in FIG. 8D. In this case, although fuel atomization may be improved, the fuel injection area is widened laterally. Accordingly, when the fuel injection valve 25' is installed in an intake manifold 31, the fuel injection position with respect to an intake valve 32 of an engine is unsatisfactory. As a result, a large amount of the injected fuel is deposited on an inner wall of the intake manifold 31 to reduce engine characteristics, especially cold starting characteristics of the engine. From the above-mentioned standpoint, the number of the fuel atomizer holes 22 in the nozzle 21 is preferably 3–6 so as to greatly reduce deposition of the fuel on the inner wall of the intake manifold 31 and to obtain satisfactory atomization as shown in FIG. 11.

Having thus described the preferred embodiments of the invention, it should be understood that numerous structural modifications and adaptations may be made without departing from the spirit of the invention.

What is claimed is:

1. A combination of a fuel injection valve and a nozzle, wherein said fuel injection valve has a single injection hole through which fuel is injected columnarly, said nozzle comprising a nozzle body attached to said fuel injection valve, and wherein said nozzle body has:

(a) three atomizer holes formed in a circle coaxial with the fuel column injected through said injection hole, said atomizer holes being in equally spaced relationship with each other and being outwardly inclined in relation to the direction of the fuel column from said fuel injection hole;

(b) a conical portion surrounded by said atomizer holes; and (c) a fuel atomizing portion formed at the upstream end of said conical portion and having a substantially pyramidal shape with a spherical peak, so that the columnar fuel injected through said injection hole is atomized in said nozzle by impacting against said atomizing portion, said atomized fuel being distributed into each of said atomizer holes, and said atomized and distributed fuel being discharged in a conical shape through said nozzle.

* * * * *